US007325622B2

(12) United States Patent
Sjostrom

(10) Patent No.: US 7,325,622 B2
(45) Date of Patent: Feb. 5, 2008

(54) EXTINGUISHING-MEDIUM CONTAINER AND SYSTEM OF CONTAINERS

(75) Inventor: Kjell Sjostrom, Katrineholm (SE)

(73) Assignee: Dafo Brand AB, Tyreso (SE)

( * ) Notice: Subject to any disclaimer, the term of this patent is extended or adjusted under 35 U.S.C. 154(b) by 318 days.

(21) Appl. No.: 10/504,417

(22) PCT Filed: Feb. 13, 2003

(86) PCT No.: PCT/SE03/00242

§ 371 (c)(1),
(2), (4) Date: Mar. 28, 2005

(87) PCT Pub. No.: WO03/068320

PCT Pub. Date: Aug. 21, 2003

(65) Prior Publication Data

US 2005/0173132 A1 Aug. 11, 2005

(30) Foreign Application Priority Data

Feb. 14, 2002 (SE) ..... 0200425

(51) Int. Cl.
*A62C 13/00* (2006.01)

(52) U.S. Cl. ..... 169/73; 169/29; 169/33; 169/85; 169/89; 239/322; 239/373

(58) Field of Classification Search ..... 169/26, 169/29, 30, 33, 73, 85, 89; 239/320, 321, 239/322, 331, 373
See application file for complete search history.

(56) References Cited

U.S. PATENT DOCUMENTS

| | | | | | |
|---|---|---|---|---|---|
| 1,207,393 | A | * | 12/1916 | Gammeter | 169/33 |
| 3,773,111 | A | * | 11/1973 | Dunn | 169/26 |
| 3,897,828 | A | * | 8/1975 | Glover | 169/26 |
| 5,660,236 | A | * | 8/1997 | Sears et al. | 169/73 |
| 5,992,531 | A | * | 11/1999 | Mikulec | 169/33 |
| 6,164,381 | A | | 12/2000 | Sundholm | |
| 6,360,825 | B1 | | 3/2002 | Padgett et al. | |
| 6,371,213 | B1 | | 4/2002 | Smith et al. | |

FOREIGN PATENT DOCUMENTS

| | | |
|---|---|---|
| SE | 514193 | 1/2001 |

* cited by examiner

*Primary Examiner*—Steven J. Ganey
(74) *Attorney, Agent, or Firm*—Young & Thompson

(57) ABSTRACT

Extinguishing-medium container includes a tubular body (2) which can be coupled together with a first and a second end piece (5, 6), which second end piece (6) has at least one outlet duct (33) for ejection of extinguishing medium (26) by a propulsion member (30) The extinguishing-medium container (1) can be charged with extinguishing medium (26) in the whole of its inner space bounded by the inner side (71) of the tubular body (2), the first and second end piece (5, 6) and a separation element (29), which separation element (29) is, in a charged state, arranged closely adjacent to the first end piece (5).

14 Claims, 5 Drawing Sheets

EXTINGUISHING-MEDIUM CONTAINER AND SYSTEM OF CONTAINERS

BACKGROUND OF THE INVENTION

The invention relates to an extinguishing-medium container according to the precharacterizing clause of Patent claim 1 and a system according to the precharacterizing clause of Patent claim 12. The invention pertains to industries for manufacturing fire-extinguishing equipment and extinguishing-medium containers, in particular equipment designed for supplying extinguishing medium to a seat of fire for a relatively long period of time, such as, for example, for 3-20 seconds. However, the invention is not limited to this industry but can also be applied to, for example, the vehicle industry and the construction industry. Various types of fire-extinguishing system are in use today in, for example, vehicles, buildings etc., which systems comprise the said fire-extinguishing equipment adapted for mechanical, manual and also semi-automatic and fully automatic systems.

Fire-extinguishing equipment is often used in engine and hydraulic spaces in vehicles and also in spaces under the compartment of the vehicle. The problem with the fire-extinguishing equipment which exists today is inter alia that it is not possible to install this equipment in an appropriate manner in the said spaces. This is due to the fact that vehicles today, to a greater extent than previously, have less space available for internal equipment. Internal components are therefore positioned closely together in vehicles, which means that it is difficult to find room for conventional fire-extinguishing equipment. A vehicle manufacturer must likewise take account of the fact that the extinguishing-medium container has to be placed in an essentially upright position so as, in the event of fire, to meet the requirements for optimum emptying by means of what are known as rising pipes arranged in the containers. This involves time-consuming work, on the one hand for the installation of such fire-extinguishing equipment and on the other hand for the vehicle design work.

Fire-extinguishing equipment exists today with extinguishing-medium containers designed so as also to accommodate a propellant gas. These also have integrated actuating devices which are often of complex design. Document WO 96/36398 discloses a fire-extinguishing apparatus which is designed to accommodate highly pressurized extinguishing medium in such a way that mist formation takes place on actuation. With this apparatus, water can be used as the extinguishing medium, which is advantageous from the environmental point of view. The problem with this construction is that it is not tailored to confined spaces, for example in a vehicle, and that the extinguishing-medium container is pressurized by propellant gas, which makes the construction more expensive and more complicated to handle.

In the vehicle design work, the vehicle manufacturer therefore has to take account to a greater extent than previously of bulky fire-extinguishing equipment and leave a larger space free in the vehicle in order for it to be possible to find room for such fire-extinguishing equipment. Some fire-extinguishing equipment is also complicated to deal with as far as refilling with extinguishing medium is concerned, which makes handling more expensive.

SUMMARY OF THE INVENTION

One object of the present invention is to produce a fire-extinguishing apparatus which can store and, in the event of fire, distribute as great a quantity of extinguishing medium as possible, even though the space intended for installation of the fire-extinguishing apparatus is small.

Another object of the present invention is to eliminate the problem of having to create extra space for a fire-extinguishing apparatus in, for example, a vehicle. The object is also to eliminate the problem with installation of a fire-extinguishing apparatus resulting from the space intended for such apparatus being inadequate.

The object is also to produce a fire-extinguishing apparatus which has a low manufacturing cost and is easy to install.

The object of the present invention is also to produce a fire-extinguishing apparatus which is easy to handle and is not costly as far as, for example, replenishing extinguishing medium is concerned.

Another object of the invention is to produce a fire-extinguishing apparatus which is easy to extend adaptably in a system from an existing space.

Another object of the invention is to eliminate the danger of pressurized extinguishing-medium containers.

The object of the present invention is also to bring about effective distribution of all the extinguishing medium in a fire-extinguishing apparatus.

The object is also to produce an extinguishing-medium container which is serviceable even if the vehicle containing the container ends up on its side or upside down in the event of an accident.

For these purposes, the extinguishing-medium container described in the introduction is characterized by the features indicated in the characterizing part of Patent claim 1. Likewise, for these purposes, a system for fire-extinguishing equipment described in the introduction is characterized by the features indicated in the characterizing part of Patent claim 12.

This means that a less bulky fire-extinguishing apparatus has been produced, which fire-extinguishing apparatus is adapted so as to distribute an optimum quantity of extinguishing medium from an existing space intended for installation, and which apparatus can form a part of a modular system. An optimum quantity of extinguishing medium can in this way be stored in the space. This means that the extinguishing-medium container can be adapted so as to be less bulky and therefore easier to position.

The outlet duct is preferably provided with an openable outflow protection means, such as a tearable membrane, a spring-loaded non-return valve etc. In this way, the extinguishing medium will not run out during mounting, the installation work thus being made easier. The extinguishing-medium container can also be mounted upside down, which is advantageous from the installation point of view.

At least one distribution means, such as a nozzle, can advantageously be connected at a distance from the outlet duct by a connection means. A part of a flexible modular system with a fire-extinguishing apparatus tailored to the purpose and the space has thus been produced.

The extinguishing-medium container can suitably be charged with extinguishing medium in an unpressurized manner via the outlet duct. In this way, riskful handling of pressurized containers is eliminated, and replenishment of extinguishing medium is made easier.

The propulsion means preferably comprises an external propulsion source, the separation means being arranged so as, to be actuatable by the said external propulsion source. The ejection medium can therefore be located in a space separated from the extinguishing-medium container so as to facilitate exchange of a container with ejection medium. Replenishment of extinguishing medium in the extinguishing-medium container is likewise made easier.

At least one inlet for ejection medium is suitably arranged in the first end piece, which inlet is arranged so as to be connectable to the propulsion source. A propellant gas or a propellant liquid, for example, can thus be used as the propulsion source.

The separation means preferably comprises a piston means arranged slidably sealingly in the tubular body between the first and the second end piece. In this way, the whole extinguishing-medium container can be filled with extinguishing medium in a simple, safe manner. The piston means acts sealingly against the inlet, by virtue of which extinguishing medium cannot run out.

The separation means is advantageously an expandable membrane. The fire-extinguishing container can thus accommodate more extinguishing medium, because the wall thickness of the expandable membrane is thinner than the thickness of a conventional piston.

The piston means suitably comprises at least one ejection duct which, when the piston means is located closely adjacent to the second end piece, opens a passage between the outlet and the propulsion source for ejection medium. It is then possible for all the extinguishing medium to be effectively distributed over a seat of fire.

The said extinguishing-medium container preferably comprises at least two tubular bodies with the same inner diameter, which tubular bodies are detachably coupled together with one another in their extension via an intermediate piece. This means that the piston means, such as a freely running piston, can act between the first and the second end piece and be guided unhindered through the two tubular bodies. An extinguishing-medium container which can be adapted to the space has thus been produced.

The first end piece of the extinguishing-medium container advantageously comprises at least one bore arranged between the inlet duct for the ejection medium and at least one side of the first end piece. A connection to a further extinguishing-medium container is thus brought about. The connection can consist of a connection adapter which is fitted into a corresponding recess of the inlet duct of the further extinguishing-medium container, by virtue of which the extinguishing medium in the containers can be ejected by means of a common external propulsion source, such as, for example, propellant gas.

SUMMARY OF FIGURES

The invention will be explained below with reference to the drawings, in which.

DETAILED DESCRIPTION OF THE INVENTION

A first preferred embodiment will now be described in greater detail with the aid of FIG. 1. Components which are not of significance to the invention are not included so as better to illustrate the various embodiments.

Figure 1:
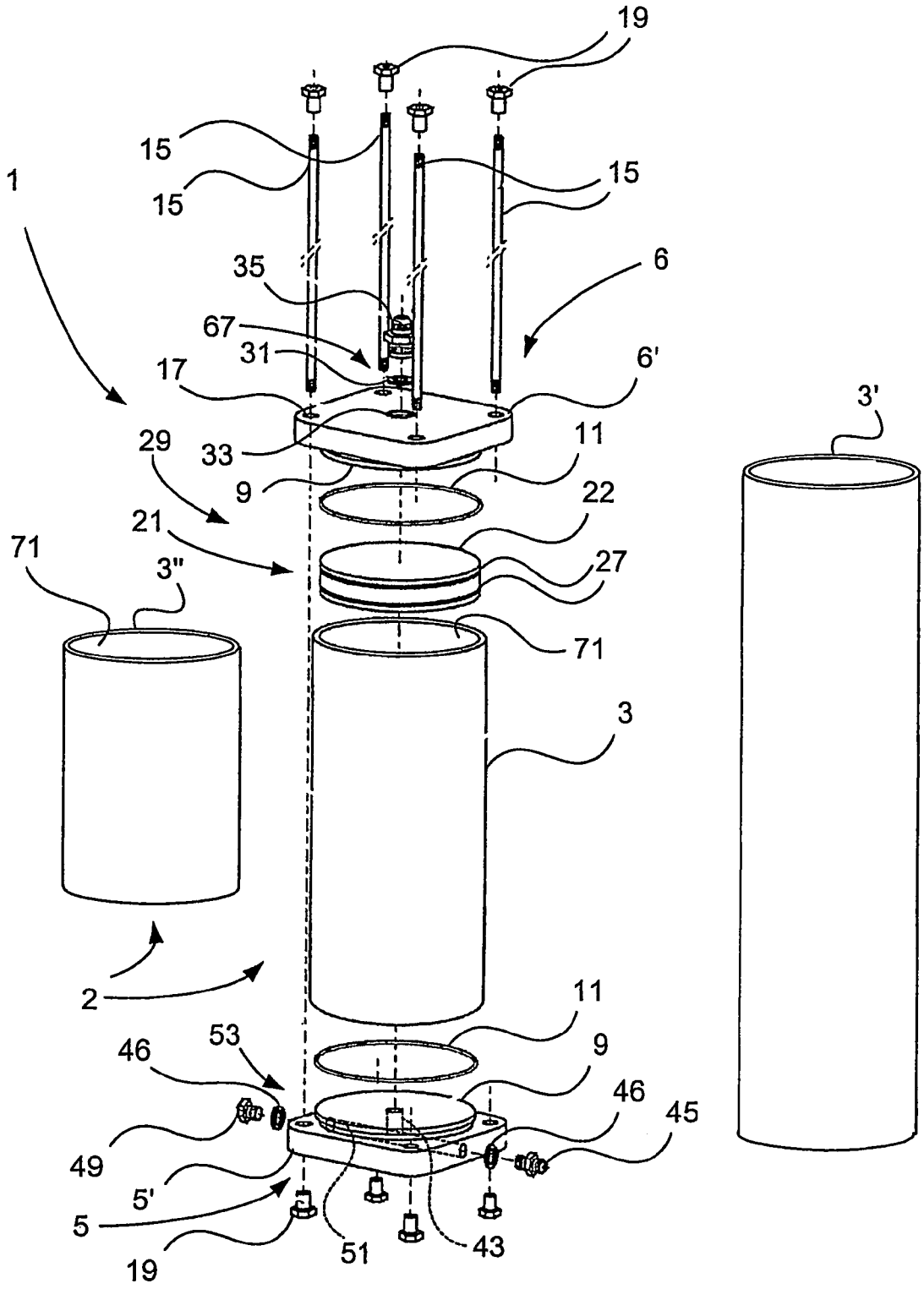
FIG. 1 illustrates diagrammatically in a perspective view an extinguishing-medium container according to the present invention in a first preferred embodiment.

FIG. 1 shows in perspective an extinguishing-medium container 1 which is also referred to below as the container 1. The container 1 comprises a tubular body 2, such as a circular tube 3, which tube 3 can be coupled together with a first and a second end piece 5, 6 respectively in the form of square end walls 5', 6'. The first and second end walls 5', 6' are designed with circular projections 9 designed so as to be capable of fitting into the ends of the tube 3. An O-ring 11 is located in a groove 13 in each projection 9 in order to achieve perfect sealing between the respective end wall 5', 6' and the tube 3.

The end walls 5', 6' are secured against the ends of the tube 3 by means of four threaded rods 15 which run through holes 17 in the end walls 5', 6'. Barrel nuts 19 are screwed onto both ends of each threaded rod 15 for tightening. Arranged in the tube 3 is a piston means 21 in the form of a circular piston 22. When the container 1 is actuated, the piston 22 divides the tube 3 into a first chamber 23 for ejection medium 24 and a second chamber 25 for extinguishing medium 26 (see FIG. 2*a*). The piston 22 comprises two piston rings 27 made of rubber in order to achieve perfect sealing and is freely slidable in the tube 3 between the end walls 5', 6'. The piston 22 functions partly as a separation means 29 separating the extinguishing medium 26 and the ejection medium 24 from one another.

A propulsion means 30 comprising an external propulsion source 44, such as a nitrogen gas cartridge, generates nitrogen gas under pressure when it is actuated, which gas constitutes the ejection medium 24. The ejection medium 24 brings about a movement of the piston 22 which in turn brings about an increase in pressure in the second chamber 25. When the pressure is approximately 10 bar, a membrane 31 applied to an outlet duct 33 in the second end wall 6' breaks, by virtue of which the extinguishing medium 26 flows out via an outlet adapter 35 to a distribution means 37 (see FIG. 5) comprising a line network 39 and nozzles 41 for distributing the extinguishing medium 26 over a potential seat of fire (not shown).

Likewise, in a charged state, because it is arranged slidably sealingly in the tube 3 between the two end walls 5', 6', the piston 22 acts as a separation means 29 covering an inlet duct 43 for the ejection medium 24 arranged in the first end wall 5'. The extinguishing medium 26 will therefore not run out during transport and installation of the container 3. The inlet duct 43 is arranged so as to be connectable to the propulsion source 44 (see FIGS. 3 and 5). A connection adapter 45 fitted sealingly in the inlet duct 43 by means of a (tredoring) 46 allows connection of a corresponding female coupling (not shown) of a line 47 connected to the external propulsion source 44.

Figure 3:
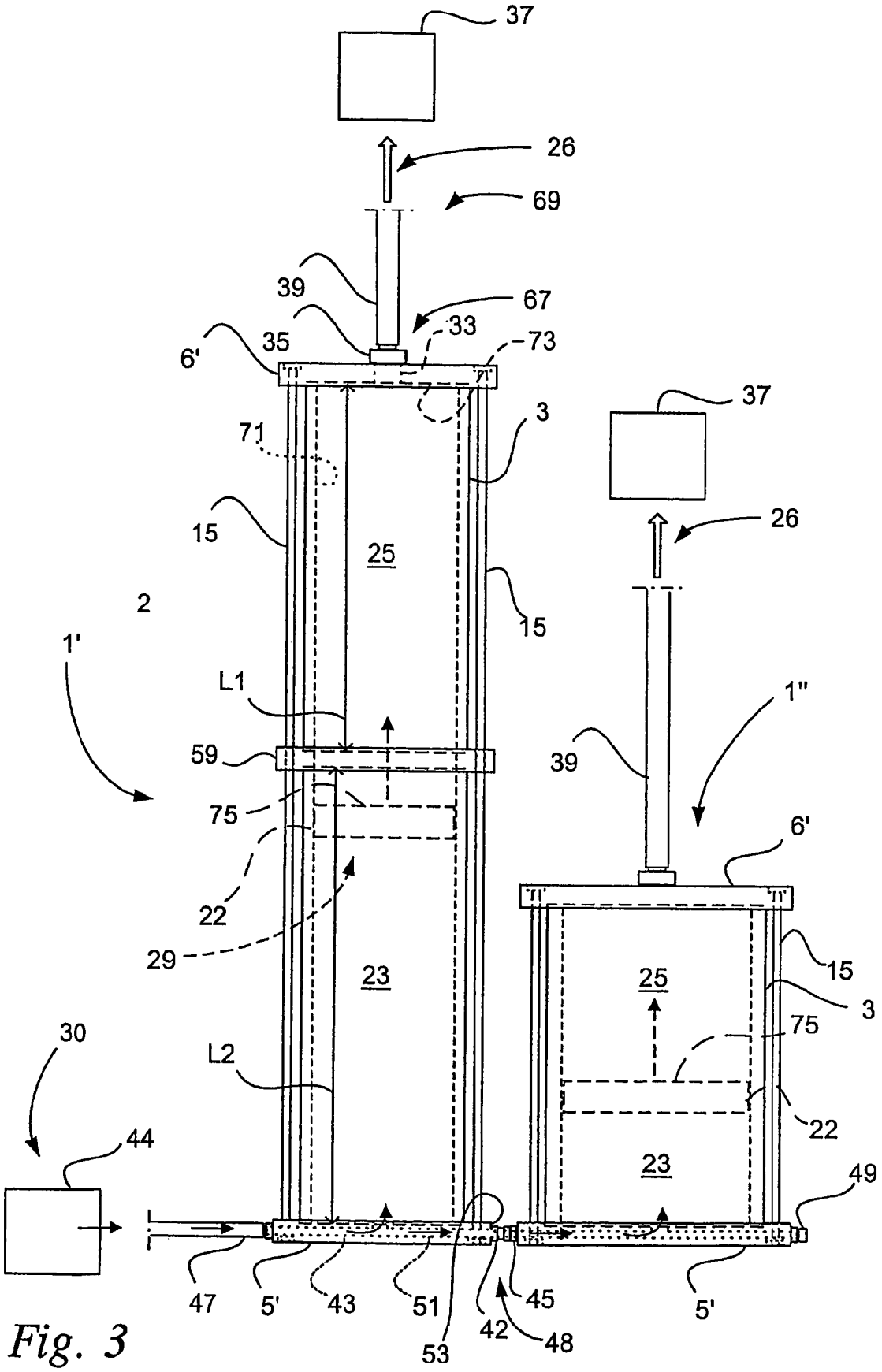
FIG. 3 illustrates diagrammatically a system for fire-extinguishing equipment comprising two extinguishing-medium containers of the type shown in FIG. 1.

FIG. 1 also shows a plug 49 which is fitted sealingly in a bore 51 intended for onward transport of the ejection medium 24 to a further container 1" (see FIG. 3). A corresponding female coupling 42 is fitted in the bore for connection to the connection adapter 45. The bore 51 is arranged between the inlet duct 43 and one side 53 of the first end wall 5'. The function of the bore 5' will be explained in greater detail below in connection with the description of FIG. 3.

By a simple action, the tube 3 can be exchanged for a longer tube 3' or a shorter tube 3" with the same diameter as the first-mentioned tube 3. In this way, the container 1 can be adapted to the existing space. All the other components, such as the piston 22, the end walls 5', 6', the connection adapter 45 etc., can be used for the adaptable container 1. The threaded rods 15, however, have to be adapted to the new tube length.

Figure 2A:
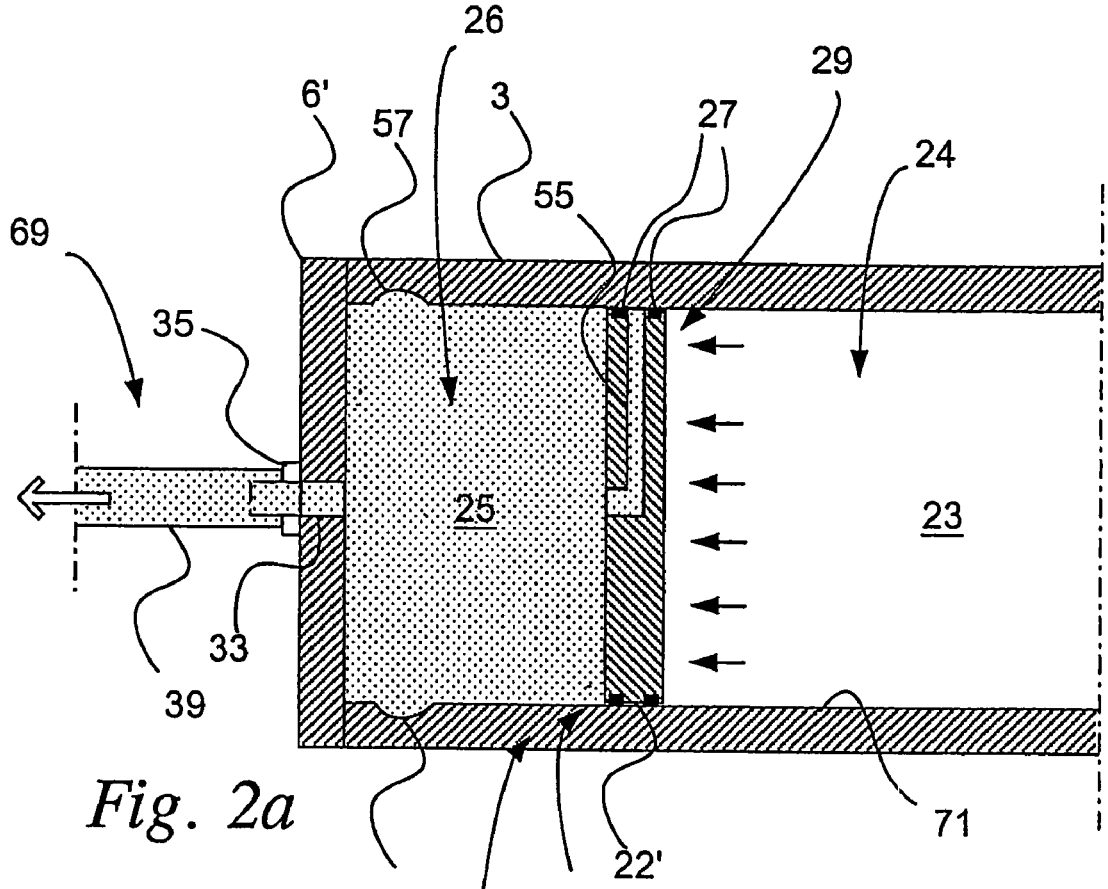
FIGS. 2*a* and 2*b* illustrate diagrammatically in a cross section a portion of an extinguishing-medium container according to a second embodiment.
Figure 2B:
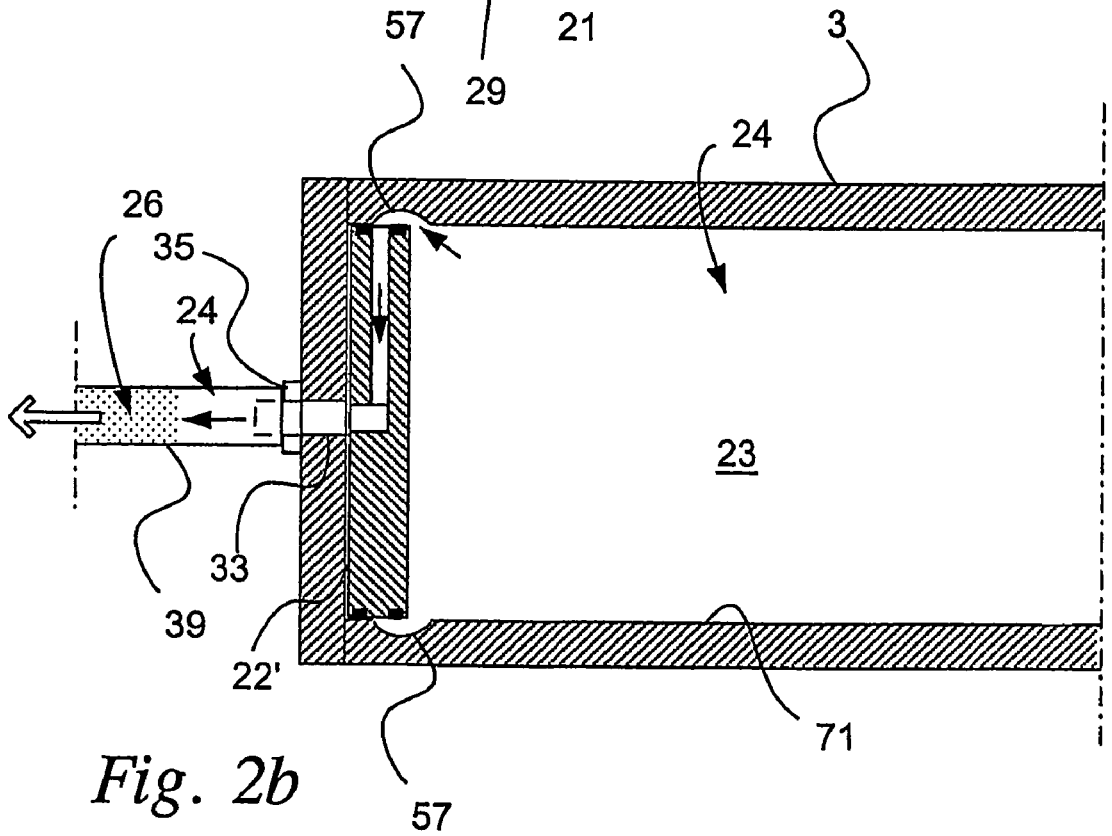

A second embodiment is shown in FIGS. 2*a* and 2*b*. An ejection duct 55 is formed in the piston 22' between the outlet duct 33 and the first chamber 23. Within the area of the end position of the piston 22' at the second end wall 6', a recess 57 is formed in the inner side 71 of the tube 3. This recess 57 is of circular design along the inner lateral surface of the tube 3 and transversely to the longitudinal direction of the tube 3 so that the ejection duct 55 always ends up with its one mouth open to the ejection medium 24 when the piston 22' is located closely adjacent to the end wall 6' in its end position. In this way, the ejection medium 24, in the form of the nitrogen gas, can travel past the piston 22' and on to the outlet duct 33, it being possible then for all the extinguishing medium 26 to be ejected from the whole line network 39.

FIG. 3 shows diagrammatically two extinguishing-medium containers 1', 1" which are coupled together and communicate with one another via a connecting means 48 comprising the connection adapter 45. The figure also shows the bore 51 formed between the inlet duct 43 and one end-wall side 53, which inlet duct 43 extends from the opposite end-wall side to the first chamber 23. The connection adapter 45 therefore interconnects the two inlet ducts 43. In this way, onward transport of the ejection medium 24 to the further container 1" can take place. The plug 49 prevents onward transport of ejection medium 24.

An arrangement for holding together and mounting the containers 1', 1" is omitted in the figure for greater clarity. This can consist of a simple fixing plate (not shown). The end walls 5', 6' are square in shape so as to allow flexibility in fitting in the containers in relation to one another.

One container 1' consists of two tubes 3 of different length L1 and L2, which tubes 3 have the same inner diameter and are mounted on one another via an intermediate piece 59. The intermediate piece 59 is arranged sealingly via sealing means (not shown) in relation to the two tubes 3, and the threaded rods 15 are tightened in such a way that perfect sealing has been brought about, on the one hand between the two tubes 3 and the intermediate piece 59 and on the other hand between the end walls 5', 6' and the respective tubes 3. The piston 22 can run freely between the two end walls 5', 6'.

The second container 1" has a greater diameter than the first container 1' and is shorter. The selection of lengths and volume of the containers 1', 1" depends on the space in which a fire-extinguishing apparatus 61 comprising the containers 1', 1" is to be installed. If for some reason it were necessary to reduce the length of the container 1' in order to find room for the apparatus, all that is necessary is to undo one end wall 5', cut the tube 3 to the desired length and remount the end wall 5'. This flexibility forms part of a modular system with extinguishing-medium containers.

The two containers 1', 1" are actuated simultaneously. The external propulsion source 44 in the form of a nitrogen gas cartridge 63 with an actuating device 65 (see FIG. 4) communicates with the inlet duct 43.

When the actuating device 65 is actuated, a pressure is generated by nitrogen gas inside the first chamber 23 of the containers 1', 1". Pressure compensation takes place between the two containers 1', 1" owing to the pressure being built up over a relatively long time. The difference can be 0.5 bar. An increase in pressure takes place thanks to the narrow passage for extinguishing medium 26 of the outlet duct 33. This situation brings about pressure compensation. Another contributing reason for the pressure compensation is the relatively slow pressure increase in the containers 1', 1". The pressure increase is not intended to break a bursting disc with great force in order to atomize the extinguishing medium in an extremely rapid operation, but the aim is to "shower" the extinguishing medium 26 over the seat of fire for a relatively long time, such as 10-15 seconds.

The respective piston 22 separates the ejection medium 24 from the extinguishing medium 26 and pressurizes the extinguishing medium 26, by virtue of which a pressure increase takes place in the respective second chamber 25 of the containers 1', 1". Openable outflow protection means 67 in the form of membranes (31, see FIG. 1) are applied to the outlet duct 33 of each container 1', 1", the extinguishing medium 26 opening the respective membranes 31 essentially simultaneously at a pressure of roughly bar. The extinguishing medium 26 is pressed by the pistons 22 out of the respective second chamber 25 of the containers 1', 1" and is transported via a connection means 69, such as the line network 39, to at least one distribution means 37 in the form of a nozzle 41 (see FIG. 4).

For replenishment, the outlet adapter 35 is demounted, and the torn membrane 31 (see FIG. 1) is removed. The containers 1', 1" are then charged via the outlet duct 33. Charging is effected in an unpressurized manner by means of a replenishment container (not shown). When the container 1 is filled completely with extinguishing medium 26, a new membrane 31 is applied, and the outlet adapter 35 is remounted. In the charged state, the extinguishing medium 26 fills the whole container 1 bounded by the inner side 71 of the tube 3, the inner side wall 73 of the second end wall 6', and by the piston 22, bounding the first end wall 5', with its piston side 75 facing the second chamber 25. In the charged state, the piston 22 is arranged adjacent to the first end wall 5'. In this way, optimum storage of extinguishing medium 26 is obtained in a space intended for the fire-extinguishing apparatus 61. In the charged state, the first chamber 23 has an on the whole non-existent volume.

Figure 4:
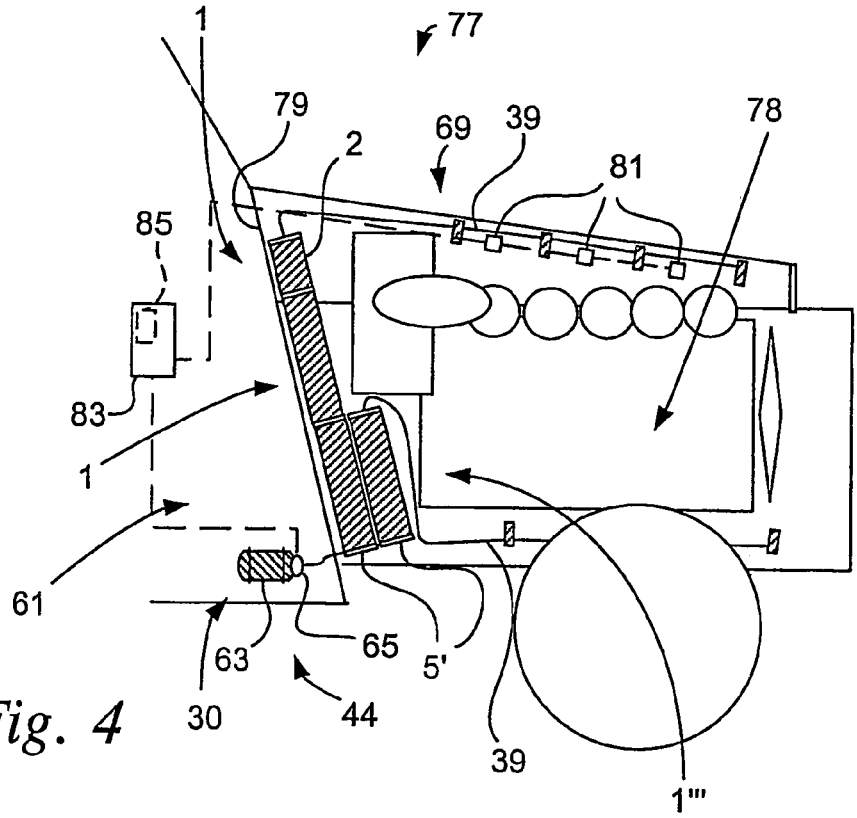
FIG. 4 illustrates diagrammatically a system, installed in a vehicle, for fire-extinguishing equipment according to the present invention.
Figure 5:
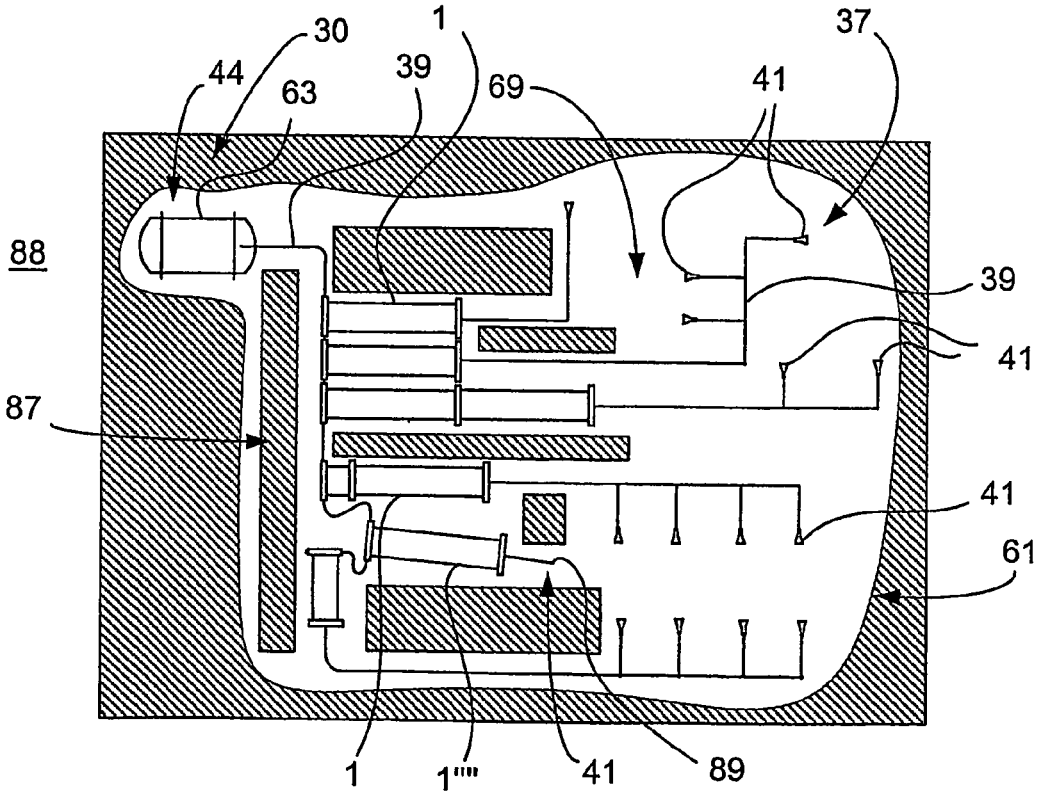
FIG. 5 illustrates diagrammatically a system for fire-extinguishing equipment comprising six of the extinguishing-medium containers shown in FIG. 1, FIGS. 6*a* and 6*b* illustrate diagrammatically an extinguishing-medium container in FIG. 1.

FIGS. 4 and 5 illustrate diagrammatically installations of systems with extinguishing-medium containers 1 in spaces where there is a shortage of room. A fire-extinguishing apparatus 61 with containers 1 of the type shown in FIG. 1 has been installed in a vehicle 77. The external propulsion source 44 in the form of the nitrogen gas cartridge 63 comprising the actuating device 65 is located in a space behind the bulkhead 79 of the vehicle 77. In the event of a fire, sensors 81 located in the engine space 78 of the vehicle 77 send signals to a central unit 83 which in turn supplies a signal to the actuating device 65 for actuation. The central unit 83 is arranged so that it could also be bypassed, manual actuation then being possible. Bypass is effected by means of an operating panel 85. FIG. 4 illustrates a system comprising two containers 1, 1'''. The containers 1, 1''' are adapted physically to the engine space 78 of the vehicle 77 by means of adjusted lengths of the tubular body 2. One container 1 is coupled together with the other container 1''' via the first end walls 5' of each container 1, 1''' and the connection comprising the connection adapter 45. In this way, containers 1 of extinguishing medium 26 of a fire-extinguishing apparatus 61 can be optimally fitted into the engine space 78. The system comprises extinguishing-medium containers 1 which can be extended adaptably for the space 78 by means of desired lengths of the tubular body 2 and can be coupled together with further extinguishing-medium containers.

FIG. 5 shows an engine space 87 in a boat 88. The fire-extinguishing apparatus 61 has been adapted to the existing engine space 87 by six containers 1 having been fitted physically in a suitable manner in the engine space 87. The extinguishing medium 26 is distributed via the line network 39 to the nozzles 41 arranged at a distance from the containers 1. Note one nozzle designed as an outflow tap 89 arranged a little way from the container 1''', which outflow tap 89 is adapted so as simply to "pour" the extinguishing medium 26 over a potential seat of fire. In this way, a heavy flow can be brought about in a given direction.

Figure 6A:
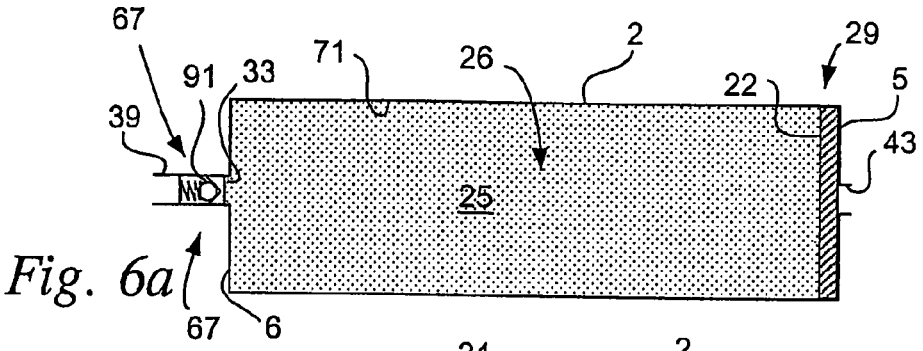
Figure 6B:
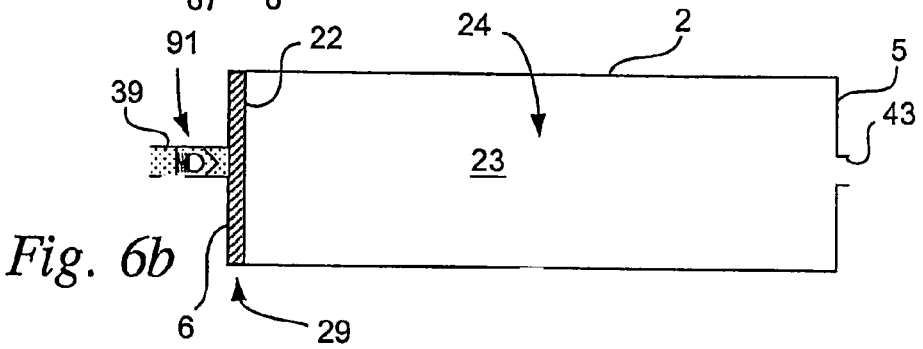

FIGS. 6*a* and 6*b* illustrate diagrammatically an extinguishing-medium container 1 according to the first embodiment and its functioning. FIG. 6*a* shows clearly that, in its charged state, the container 1 accommodates extinguishing medium 26 in the whole of its inner space. The openable outflow protection means 67 consists of a spring-loaded non-return valve 91, the function of which is to prevent the extinguishing medium 26 running out. Arranged after the non-return valve 91 is the line network 39, the function of which is to transport the extinguishing medium 26 to the nozzle 41 (see FIG. 5) located at a distance. FIG. 6*b* shows when the piston 22 is in its position for emptying all the extinguishing medium 26 from the container 1, the ejection medium in the form of the propellant gas then filling the first chamber 23.

Figure 7:
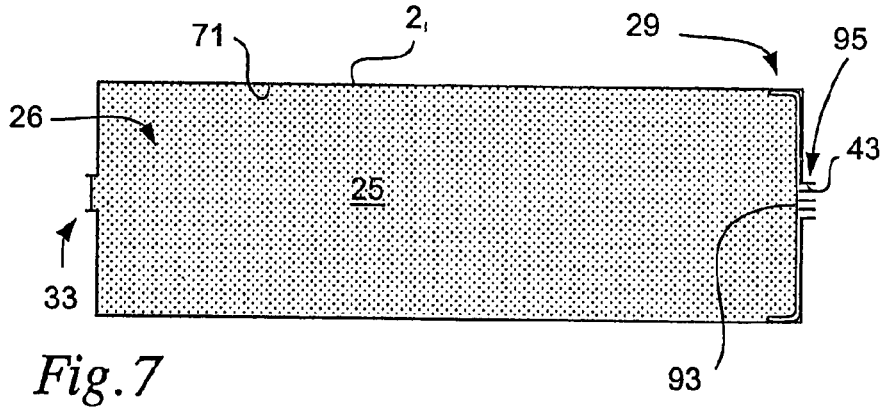
FIG. 7 illustrates diagrammatically an extinguishing-medium container according to a third embodiment.

FIG. 7 illustrates diagrammatically an extinguishing-medium container 1 according to a third embodiment. In this embodiment, the separation means 29 is an expandable bellows 93. The bellows 93 is arranged so as to expand with the aid of a propellant liquid 95 which can be pressurized by means of a propulsion source (not shown). The bellows 93 in turn pressurizes the extinguishing medium 26 which causes the membrane 31 to break, it then being possible for the whole inner volume of extinguishing medium 26 in the container 1 to be distributed to the distribution means 37 via the outlet duct 33.

Figure 8:
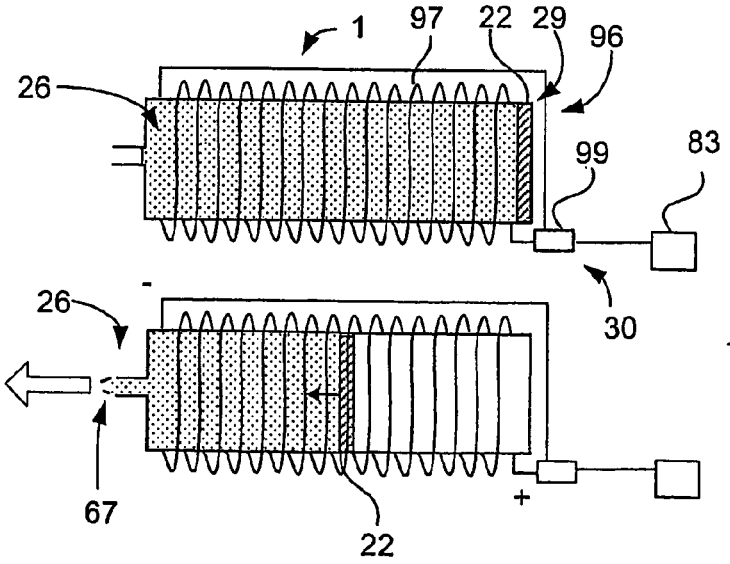
FIG. 8 illustrates diagrammatically an extinguishing-medium container according to a fourth embodiment.

FIG. 8 illustrates diagrammatically an extinguishing-medium container 1 according to a fourth embodiment. This embodiment can be implemented in practice when the electrical system generally is developed in such a way that good operational reliability is obtained. Alternatively, use can be made of double electrical systems in order to afford high reliability. In this embodiment, the propulsion means 30 comprises an external propulsion source 44 in the form of a linear motor 96, where the piston 22 consists of an iron core encased in polymer. A winding 97 connected to a battery 99 is adapted so as to cause the piston 22 to move, it then being possible for the extinguishing medium 26 to be ejected.

Other modifications can be applied within the scope of the present invention. Actuation of a number of containers can take place simultaneously. An alternative is to build in a two-stage system comprising a central unit which controls the actuation of the various containers with a time interval. The invention can be adapted for fire-extinguishing equipment intended for mechanical, manual and also semi-automatic and fully automatic systems. The system can also involve the use of only one central container connected to a number of nozzles.

The invention can consist of a combination of the various parts in the embodiments described above or containers according to one embodiment can be combined with another embodiment.

The separation means 29 can consist of a partition (not shown) arranged in the inlet duct 43. When a propellant liquid with great density passes through the inlet duct under pressure, the partition is torn apart. The propellant liquid with greater density than the extinguishing medium 26 presses the extinguishing medium 26 out into the line network for spreading over a potential seat of fire.

According to another embodiment, the external propulsion source can comprise a small recess in the first chamber 23 intended for application of a chemical substance which is intended to expand in the first chamber and in this way press the extinguishing medium out.

The tubular body can also be square, oval etc. in its cross section. The end walls are advantageously of square design in order to facilitate mounting work according to a modular system, but other shapes can also be used within the scope of the invention.

The invention claimed is:

1. Extinguishing-medium container comprising a tubular body (2) which can be coupled together with a first and a second end piece (5, 6), which second end piece (6) comprises at least one outlet duct (33) for ejection of extinguishing medium (26) by a propulsion means (30), characterized in that the extinguishing-medium container (1) can be charged with extinguishing medium (26) in the whole of its inner space bounded by the inner side (71) of the said tubular body (2), the first and the second end piece (5, 6) and a separation means (29), which separation means (29) is, in a charged state, arranged closely adjacent to the said first end piece (5), wherein at least one distribution means (37) is connected at a distance from the said outlet duct (33) by a connection means (69), and wherein said propulsion means (30) comprises an external propulsion source (44), the said separation means (29) being arranged so as to be actuatable by the said external propulsion source (44).

2. Extinguishing-medium container according to claim 1, characterized in that the said outlet duct (33) is provided with an openable outflow protection means (67).

3. Extinguishing-medium container according to claim 1, characterized in that the said extinguishing-medium container (1) can be charged with extinguishing medium (26) in an unpressurized manner via the said outlet duct (33).

4. Extinguishing-medium container according to claim 1, characterized in that at least one inlet duct (43) for ejection medium (24) is arranged in the said first end piece (5), which inlet duct (43) is arranged so as to be connectable to the said external propulsion source (44).

5. Extinguishing-medium container according to claim 1, characterized in that the said separation means (29) comprises a piston means (21) arranged slidably sealingly in the said tubular body (2) between the said first and second end pieces (5, 6).

6. Extinguishing-medium container according to claim 1, characterized in that the said separation means (29) is an expandable bellows (93).

7. Extinguishing-medium container according to claim 5, characterized in that the said piston means (21) comprises at least one ejection duct (55) which, when the said piston means (21) is located closely adjacent to the said second end piece (6), opens a passage between the said outlet duct (33) and the said external propulsion source (44) for ejection medium (24).

8. Extinguishing-medium container according to claim 1, characterized in that the said extinguishing-medium container (1) comprises at least two tubular bodies (2) with the same inner diameter, which tubular bodies (2) are detachably coupled together with one another in their extension via an intermediate piece (59).

9. Extinguishing-medium container according to claim 1, characterized in that the said first end piece (5) of the said extinguishing-medium container (1) comprises at least one bore (51) arranged between the said inlet duct (43) and at least one side of the said first end piece (5).

10. System comprising at least one extinguishing-medium container according to claim 1, characterized in that the said extinguishing-medium container (1) can be extended adaptably for a space (78, 87) by means of desired lengths of the tubular body (2) and can be coupled together with a further at least one of the said extinguishing-medium containers (1'), the inlet duct (43) of the said extinguishing-medium container (1) communication with the inlet duct of the said further extinguishing-medium container (1') via a connecting means (48) arranged between the respective first end pieces (5, 6).

11. Extinguishing-medium container according to claim 2, characterized in that at least one distribution means (37), such as a nozzle, can be connected at a distance from the said outlet duct (33) by a connection means (69).

12. Extinguishing-medium container according to claim 4, characterized in that the said separation means (29) comprises a piston means (21) arranged slidably sealingly in the said tubular body (2) between the said first and second end pieces (5, 6).

13. Extinguishing-medium container according to claim 4, characterized in that the said separation means (29) is an expandable bellows (93).

14. Extinguishing-medium container according to claim 12, characterized in that the said piston means (21) comprises at least one ejection duct (55) which, when the said piston means (21) is located closely adjacent to the said second end piece (6), opens a passage between the said outlet duct (33) and the said external propulsion source (44) for ejection medium (24).

* * * * *